US006807933B2

(12) United States Patent
Lipski

(10) Patent No.: US 6,807,933 B2
(45) Date of Patent: Oct. 26, 2004

(54) MULTIPLE SPARKING IGNITION DEVICE

(76) Inventor: Mark C. Lipski, 740 Wigley, Mineola, TX (US) 75773

( * ) Notice: Subject to any disclaimer, the term of this patent is extended or adjusted under 35 U.S.C. 154(b) by 88 days.

(21) Appl. No.: 10/285,740

(22) Filed: Nov. 1, 2002

(65) Prior Publication Data

US 2004/0084001 A1 May 6, 2004

(51) Int. Cl.[7] ..... H01T 13/46

(52) U.S. Cl. ..... 123/169 EL; 123/169 MG; 123/163; 313/123

(58) Field of Search ..... 123/169 E, 169 EL, 123/169 MG, 163, 310, 143 B; 313/123, 141, 51

(56) References Cited

U.S. PATENT DOCUMENTS 1,476,252 A * 12/1923 Hempel ..... 313/51
2,904,610 A * 9/1959 Morrison ..... 123/169 R
3,589,348 A * 6/1971 Reichhelm ..... 123/169 PB
3,921,020 A * 11/1975 Wax ..... 313/123
4,029,986 A * 6/1977 Lara et al. ..... 313/123
4,470,392 A * 9/1984 Yoshinaga et al. ..... 123/310
4,535,735 A * 8/1985 Yoshinaga et al. ..... 123/310
5,046,466 A * 9/1991 Lipski ..... 123/310
5,074,262 A * 12/1991 McAbee et al. ..... 123/169 MG
5,821,675 A * 10/1998 Suzuki ..... 313/123
6,603,245 B1 * 8/2003 Fletcher ..... 313/141

FOREIGN PATENT DOCUMENTS

GB 2202274 A * 9/1988 ..... F02B/19/16

* cited by examiner

*Primary Examiner*—Mahmoud Gimie
*Assistant Examiner*—Arnold Castro

(57) ABSTRACT

The ignition system of the present invention involves the forming of multiple ignition sparks within the fuel-burning chamber of an internal combustion engine during each cylinder combustion cycle through electrical current flow through a plurality of electrodes functioning in series and forming at least two sparking gaps where the initial and last electrode in the electrode series respectively function as anode and cathode (ground) electrodes.

14 Claims, 2 Drawing Sheets

FIG. 1
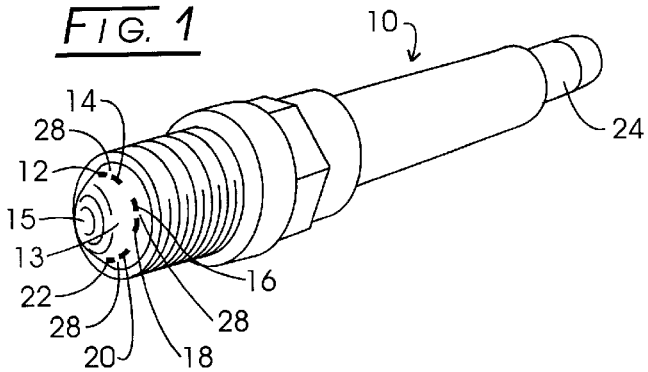
FIG. 2
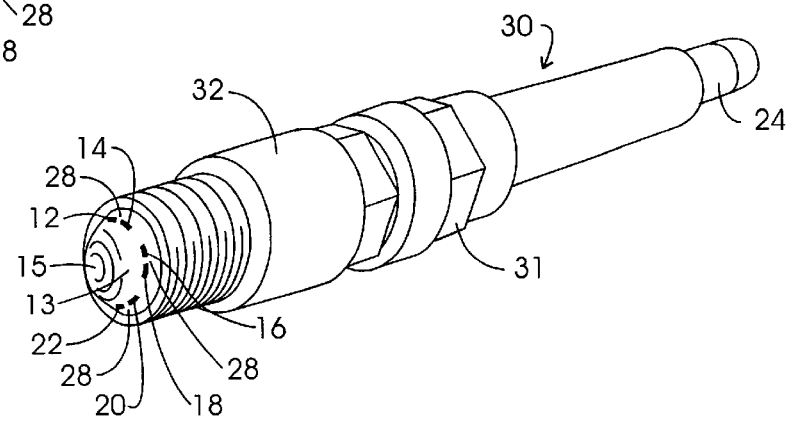
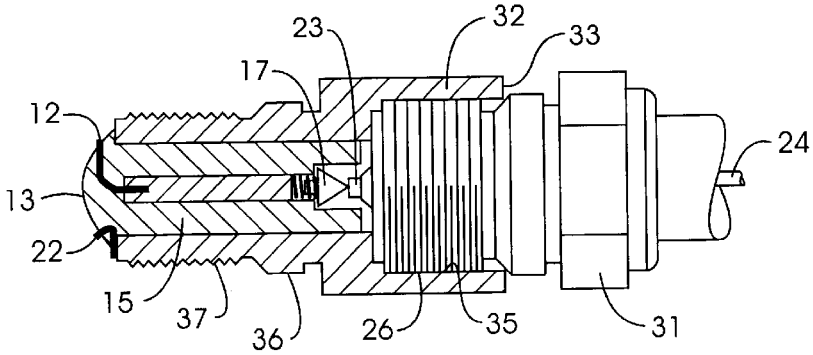
FIG. 3
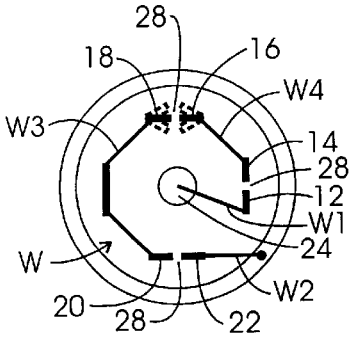
FIG. 4
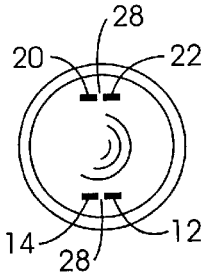
FIG. 5
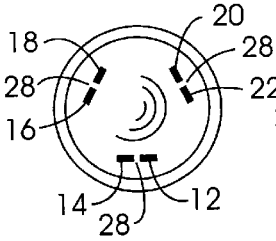
FIG. 6
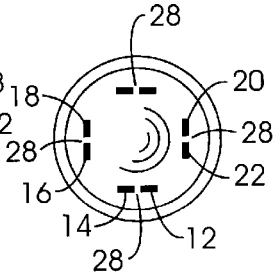
FIG. 7

MULTIPLE SPARKING IGNITION DEVICE

CROSS-REFERENCES

None.

FIELD OF THE INVENTION

The present invention relates generally to the operation of internal combustion engines, and particularly concerns apparatus and methods for developing a series of sparks within an internal combustion engine combustion chamber during each engine cylinder combustion cycle.

BACKGROUND OF THE INVENTION

There has long been a need in the United States for an internal combustion engine that functions to "burn" fuel more efficiently, to reduce undesirable engine combustion emissions, and to simultaneously increase power output. Spark plug devices which can enhance engine performance by optimally accommodating a wide range of engine loads and speeds are needed to increase engine efficiency. Spark plug devices which can accommodate different fuels such as ethanol, methanol, nitrous oxide, hydrogen, gasoline and propane within an internal combustion engine without being changed are needed because modern internal combustion engines are designed to operate on a variety of fuel types. Many different forms of conventional spark plug devices for causing ignition of fuel in the cylinder of an internal combustion engine are known. However, none of the known spark plug devices accomplish engine combustion ignition in a manner that meets the foregoing stated needs. Also, known spark plug devices can not optimally accommodate wide ranges of engine loads and speeds and can not accommodate many different types of fuels.

Accordingly, a principal object of the present invention is to provide a method and apparatus for causing ignition of fuel in the fuel-burning chamber of an internal combustion engine in a manner that produces highly efficient fuel "burning".

Another object of the present invention is to provide a method and apparatus for causing ignition of fuel in the fuel-burning chamber of an internal combustion engine that effects a reduction of undesirable combustion product emissions.

A further object of the present invention is to provide a method and apparatus for causing ignition of fuel in the fuel-burning chamber of an internal combustion engine that is accomplished with improved engine power output.

Still another object of the present invention is to provide a spark plug device which optimally can accommodate a wide range of engine loads and speeds.

A still further object of the present invention is to provide a spark plug device which optimally can accommodate different fuels.

Other objects and advantages of the present invention will become apparent during consideration of the detailed descriptions, drawings, and claims which follow.

SUMMARY OF THE INVENTION

The ignition system of the present invention involves the forming of multiple ignition sparks within the fuel-burning chamber of an internal combustion engine during each cylinder combustion cycle through electrical current flow through a plurality of electrodes functioning in series and forming at least two sparking gaps where the initial and last electrode in the electrode series respectively function as system anode and cathode (ground) electrodes.

BRIEF DESCRIPTION OF THE DRAWINGS

FIG. 1 schematically illustrates an internal combustion engine spark plug having six electrodes arranged in series in accordance with a preferred embodiment of the present invention;

FIG. 2 schematically illustrates an internal combustion engine spark plug having six electrodes arranged in series, the electrode arrangement being in the form of an add-on adapter for a basic conventional dual-electrode spark plug;

FIG. 3 is a longitudinal section view taken through an end region of the spark plug combination of FIG. 2;

FIG. 4 is a schematic view of an adapter end showing an electrode wiring diagram;

FIGS. 5 through 7 schematically and respectively illustrate the different combinations of electrodes that obtain from two to four serial sparks in each invention firing cycle;

DETAILED DESCRIPTION

Figure 8:
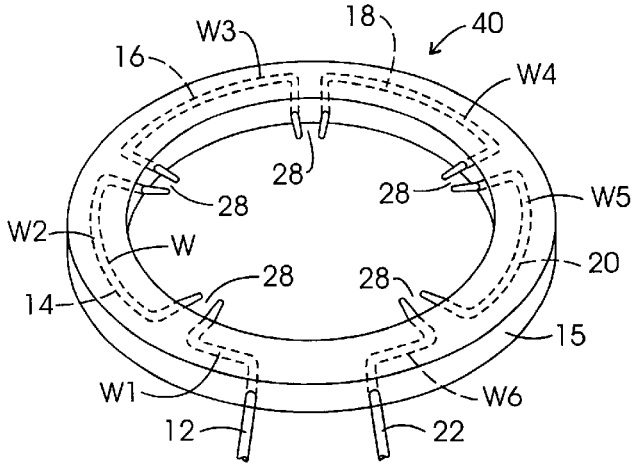
FIG. 8 is a schematic perspective view of the present invention in an alternate form suitable for installation in an annular recess of a counter bore provided within a combustion chamber of an internal combustion engine.

In FIG. 1 I illustrate an internal combustion engine spark plug 10 having six different electrodes 12 through 22 electrically combined in series as a preferred embodiment of the present invention. Electrodes 12 through 22 are generally circumferentially arranged and embedded within and project from the surface 13 of an insulated element 15 affixed to the lower externally threaded body portion 26 of spark plug 10. Preferably electrodes 12 through 22 are formed from a single continuous conductor wire embedded within insulator element 15 with electrodes 12 through 22 projecting through the surface 13 of insulator element 15. See FIG. 3. The electrode sparking gaps 28 are formed from cutting the portion of the continuous conductor wire which projects above the free end or surface 13 of the insulator element 15 at the locations where electrodes are desired to form gaps 28 of desired width. The electrodes 12 through 22 may be bent to obtain a desired width sparking gap 28. See FIG. 4. Additionally, the gaps 28 may be sized differently to provide different sparks to accommodate different fuels and different engine operating parameters. Although electrodes 12 through 22 are depicted in a generally circular configuration, they may be arranged in any desired pattern including a straight line.

The initial and last electrodes, 12 and 22 in the electrode series respectively, function as system anode and cathode (ground) electrodes. Electrode 12 is connected to and is electrically a part of the spark plug conventional anode or power supply connector 24 and electrode 22 is electrically connected to the ground or non-insulated metallic threaded body portion 26 of spark plug 10. Each adjacent pair of electrodes in the series is separated by a sparking gap 28. When a voltage is applied to the spark plug power supply connector 24, a spark is developed across each of the sparking gaps 28. Preferably, electrodes 12 through 22 are constructed of platinum-coated, nickel wire although other suitable materials may be substituted therefore. The spark plug 10 of FIG. 1 includes a series of three serial spaced-apart sparking gaps 28.

FIG. 2 illustrates a different embodiment of the present invention designated 30 and also having a generally similar arrangement of electrodes 12 through 22 as in FIG. 1, but such are incorporated in the insulated element 15 of a threaded add-on adapter 32 appended to a conventional spark plug 31. Elements similar to those in FIG. 2 are identified by identical numbers. Preferably, the ground electrode of spark plug 31 is removed prior to being threaded into adapter 32. Adapter 32 has a cylindrical metallic upper receiver portion 33 with an internal thread 35 adapted to receive the lower threaded portion 26 of conventional single electrode spark plug 31. Adapter 32 has a cylindrical lower body portion 36 with a metallic threaded portion 37 having the same diameter and thread size as that of conventional spark plug 31. Preferably electrodes 12 through 22 are formed from a single conductor embedded within insulator element 15 with electrodes 12 through 22 projecting through the surface 13 of insulator element 15. The electrode sparking gaps 28 are formed from cutting the portions of the continuous wire which project above the free end or surface 13 of the insulator element 15 at the locations where electrodes are desired to form sparking gaps 28 of desired width. The electrodes 12 through 22 may be of different lengths and/or may be bent to obtain a desired width sparking gap 28 and to precisely position the sparking gap 28. Additionally, one or more of the sparking gaps 28 may be sized differently to provide different sparks to accommodate different fuels and different engine operating parameters. Although electrodes 12 through 22 are depicted in a generally circular configuration, they may be arranged in any desired pattern including a straight line.

It should be noted that electrode 12 comprises a moveable spring biased conductor element 17 connected to and electrically connected to one end 23 of spark plug anode and power supply connector 24, and electrode 22 is electrically connected to the ground or non-insulated metallic threaded body portion 26 of the conventional spark plug 31. When a voltage is applied to power supply connector 24, a spark is developed across each of the sparking gaps 28. In both embodiments 10 and 30, and throughout the drawings of this application, the included electrical insulation element, usually a high-temperature ceramic material, is designated 15. The insulation material also may be aluminum oxide or an epoxy-based material depending upon the application of the device. It should be understood that the different electrodes 12 through 22 in each sparking device assembly are each at least partially embedded or potted or molded in molded insulating element 15 for the purpose of retaining the electrodes in their proper relative positions. Insulating material is provided to fill the gap between electrodes 12 and 22.

FIG. 4 is an electrical schematic depicting the method of forming electrodes 12 through 22 from a single continuous wire W embedded within insulator element 15. Wire W lies above the surface 13 of insulator element 15 at locations where sparking gaps 28 are desired. One end section W1 of wire W embedded in insulator element 15 is connected to power supply connector 24 and forms electrode 12. The other end section W2 of wire W embedded in insulator element 15 is connected to ground or non-insulated metallic threaded body portion 26 of a spark plug 31 and forms electrode 22. An end of a third section W3 of wire W embedded in insulator element 15 form electrodes 18 and 20, and the ends of a fourth section W4 of wire W embedded in insulator element 15 form electrodes 14 and 16. It may be observed that there are one fewer sparking gaps 28 (three) than the number of serial electrode wire sections (four).

FIGS. 5 through 7 depict a spark plug 10 or an adapter 32 having from two to four serial spaced-apart sparking gaps 28. The electrodes defining the sparking gaps 28 for these embodiments may be manufactured utilizing the method depicted in connection with the FIG. 4 embodiment above.

Figure 9:
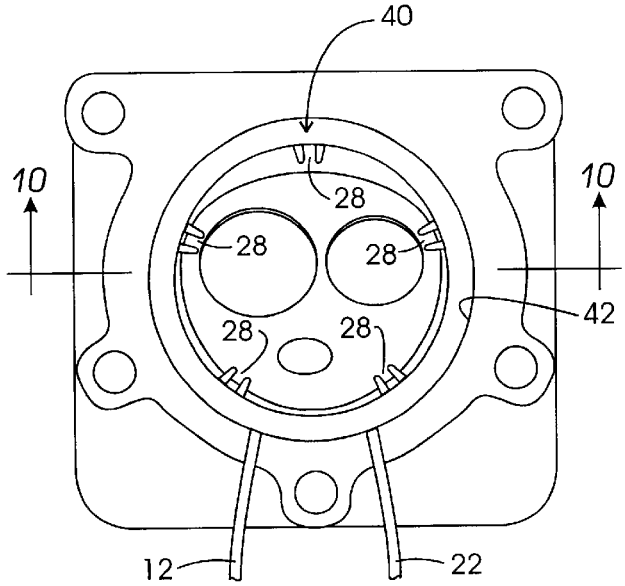
FIG. 9 illustrates, in plan, the FIG. 8 invention embodiment installed in an internal combustion engine cylinder head recess.
Figure 10:
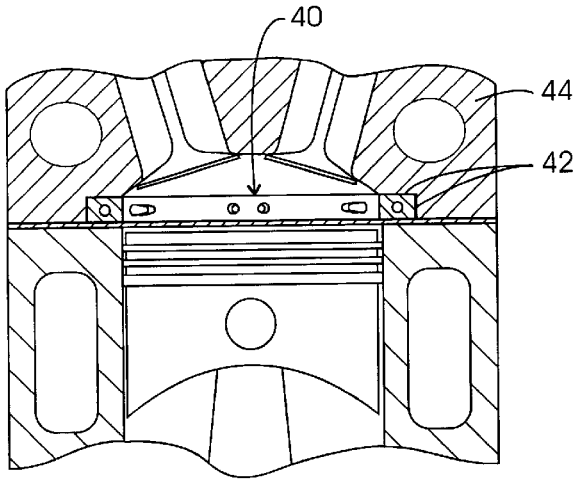
FIG. 10 is a sectional view taken along line 10—10 of FIG. 9.

FIGS. 8 through 10 illustrate still another sparking device embodiment 40 of the present invention that is distinguished by the fact that it is installed in a recess or counter bore 42 provided in an engine cylinder head 44 rather than in a conventional threaded spark plug opening in the wall or head of the engine cylinder. It should be observed that sparking device 40 also may be installed in a recess formed in an engine block where the piston has sufficient clearance. Note from FIG. 8 that each of invention electrodes 12 through 22 is embedded or molded in electrical insulation material 15, which preferably is a high-temperature ceramic material, in the manner shown. Preferably electrodes 12 through 22 are formed from a single conductor within insulator element 15 with electrodes 12 through 22 projecting through the surface of insulator element 15. The electrode gaps are formed from cutting a portion of the continuous wire W which projects above the surface of insulator element 15 to form electrode wire sections W1 through W6 at the locations where electrodes are desired to form sparking gaps 28 of desired width. The electrodes 12 through 22 may be bent to obtain a desired gap 28. Additionally, the gaps 28 may be sized differently to provide different sparks to accommodate different fuels and different engine operating parameters. It may be seen that there are one fewer electrode sparking gaps 28 (five) than the number of serial electrode wire sections (six). Although electrodes 12 through 22 are depicted as equally spaced, they may be spaced in any desired manner to obtain optimum engine performance. Additionally, the sparking gaps 28 have different widths to also obtain optimum engine performance. It should be noted that one of electrodes 12 or 22 is connected electrically to a positive voltage supply and the other electrode 12 or 22 is connected to ground. When voltage is applied to the electrodes 12 and 22, a spark is developed across each of the sparking gaps 28.

Various changes in shape, size, proportioning, and materials of construction may be made without departing from the scope, meaning, or intent of the claims which follow.

I claim as my invention:

1. A spark plug-type ignition device for insertion into the combustion chamber of an internal combustion engine, and comprising:

a threaded metallic body having an external electrically conductive power supply extension;

an electrical insulator joined to said threaded metallic body and having an outer surface;

an electrical series of a plurality of consecutive spaced-apart electrodes; and wherein said plurality of spaced-apart electrodes define at least two sparking gaps; the first of said electrical series of spaced-apart electrodes being partially contained within and projecting from the outer surface of said electrical insulator and electrically connected to said threaded metallic body, the last of said electrical series of spaced-apart electrodes electrically connected to said electrically conductive power supply external extension of said threaded ignition device body, and each one of said sparking gaps separating a different pair of adjacent electrodes in said electrical series of spaced-apart electrodes, wherein each of said electrodes are partially embedded in said electrical insulator, wherein outer ends of said electrodes project above said outer surface of said electrical insulator and are individually moveable to adjust said sparking gaps.

2. The spark plug-type ignition device of claim 1, wherein said electrodes are spaced such that said sparking gaps are of unequal widths.

3. A multi-sparking adapter for combination with a spark plug device having a threaded metallic body with an electrically conductive power supply extension, an electrical insulator joined to the spark plug device threaded metallic body, and an anode electrode contained within, and projecting from one end of the electrical insulator and electrically connected to said conductive power supply extension, and comprising:

an externally threaded multi-sparking adapter metallic body having an external electrically conductive extension and an internal thread corresponding to the thread of the spark plug device threaded metallic body;

an electrical insulator element contained within said adapter metallic body having a free end surface;

an electrical series of a plurality of consecutive spaced-apart electrodes; and wherein said plurality of spaced-apart electrodes define at least two sparking gaps;

the first of said electrode series of spaced-apart electrodes being partially contained within said electrical insulator element and having one end electrically connected to the anode electrode of the spark plug device, the last of said electrical series of spaced-apart electrodes being electrically connected to said externally threaded adapter metallic body, and each one of said sparking gaps separating a different pair of adjacent electrodes in said electrode series.

4. The multi-sparking adapter of claim 3, wherein each of said electrodes are partially embedded in said electrical insulator.

5. The multi-sparking adapter of claim 4, wherein said electrodes are spaced such that said sparking gaps are of unequal widths.

6. The multi-sparking adapter of claim 4, wherein the outer ends of said electrodes project above said free end of said electrical insulator element and are individually moveable to adjust said sparking gaps.

7. An insert assembly for insertion within an annular recess provided in the head region of an internal combustion engine combustion chamber, and comprising: an electrical series of a plurality of consecutive spaced-apart electrodes; wherein said plurality of spaced-apart electrodes define at least two sparking gaps; and an electrical insulator having an annular form an outer surface and substantially, but not entirely, encapsulating said electrical series of consecutive spaced-apart electrodes; said electrical insulator being sized and configured such that the cylinder head facing surface is in direct contact with the cylinder head when cooperating with the annular recess provided in the head region of an internal combustion engine combustion chamber, the tip portions of said electrical series electrodes projecting outwardly of said electrical insulator toward the internal combustion engine combustion chamber, and the first and last electrodes of said electrode series having leads projecting outwardly of said electrical insulator toward the internal combustion engine exterior.

8. The insert assembly of claim 7, wherein said electrodes are spaced such that said sparking gaps are of unequal widths.

9. The insert assembly of claim 7, wherein the outer ends of said electrodes project above said outer surface and are individually moveable to adjust said sparking gaps.

10. A spark plug-type ignition device for insertion into the combustion chamber of an internal combustion engine, and comprising:

a threaded metallic body having an external electrically conductive power supply extension;

an electrical insulator joined to said threaded metallic body and having a free end;

an electrical series of at least three of consecutive spaced-apart electrode wire sections; and one fewer sparking gaps than the number of electrode wire sections in said electrode wire section series of at least three consecutive spaced-apart electrode wire sections; the first of said electrical series of at least three electrode wire sections being partially contained within and projecting from the free end of said electrical insulator and electrically connected to said threaded metallic body, the last of said electrical series of at least three spaced-apart electrode wire sections electrically connected to said electrically conductive power supply external extension of said threaded ignition device body, and each one of said fewer sparking gaps separating a different pair of adjacent electrode wire sections in said electrical series of at least three consecutive electrode wire sections; wherein outer ends of said electrode wire sections project above an outer surface of said electrical insulator and are individually moveable to adjust said fewer sparking gaps.

11. The spark plug ignition device of claim 10, wherein each of said electrode wire sections are partially embedded in said electrical insulator.

12. A multi-sparking adapter for combination with a spark plug device having a threaded metallic body with an electrically conductive power supply extension, an electrical insulator joined to the spark plug device threaded metallic body, and an anode electrode contained within, and projecting from one end of the electrical insulator and electrically connected to said conductive power supply extension, and comprising:

an externally threaded multi-sparking adapter metallic body having an external electrically conductive extension and an internal thread corresponding to the thread of the spark plug device threaded metallic body;

an electrical insulator element contained within said adapter metallic body having a free end surface;

an electrical series of at least three consecutive spaced-apart electrode wire sections;

and one fewer sparking gaps than the number of electrode wire sections in said electrical series of at least three consecutive spaced-apart electrode wire sections; the first of said electrode series of at least three electrode wire sections being partially contained within said electrical insulator element and having one end electrically connected to the anode electrode of the spark plug device, the last of said electrical series of at least three electrode wire sections being electrically connected to said externally threaded adapter metallic body, and each one of said one fewer sparking gaps separating a different pair of adjacent electrode wire sections in said electrode wire section series.

13. The multi-sparking adapter of claim 12, wherein each of said electrode wire sections are partially embedded in said electrical insulator.

14. An insert assembly for insertion within an annular recess provided in the head region of an internal combustion engine combustion chamber, and comprising: an electrical series of at least three consecutive spaced-apart electrode wire sections; one fewer sparking gaps than the number of electrode wire sections in said electrical series of consecutive spaced-apart electrode wire sections; and an electrical insulator having an annular form, an outer surface and substantially, but not entirely, encapsulating said electrical series of consecutive spaced-apart electrode wire sections; said electrical insulator being sized and configured to co-operate with the annular recess provided in the head region of an internal combustion engine combustion chamber, the tip portions of said electrical series electrode wire sections projecting outwardly of said electrical insulator toward the internal combustion engine combustion chamber, wherein outer ends of said electrodes project above said outer surface of said electrical insulator and are individually moveable to adjust said sparking gaps, and the first and last electrode wire sections of said electrode series having leads projecting outwardly of said electrical insulator toward the internal combustion engine exterior.

* * * * *